US011970320B2

(12) United States Patent
Savage et al.

(10) Patent No.: US 11,970,320 B2
(45) Date of Patent: Apr. 30, 2024

(54) CONTAINER ASSEMBLY WITH CAP WITH STEM

(71) Applicant: Smoothee Inc., Berkeley, CA (US)

(72) Inventors: Ryan Savage, Teachey, NC (US); Matthew Cote, Berkeley, CA (US); Lauren Fraser, Berkeley, CA (US)

(73) Assignee: Smoothee Inc., Berkeley, CA (US)

( * ) Notice: Subject to any disclaimer, the term of this patent is extended or adjusted under 35 U.S.C. 154(b) by 146 days.

(21) Appl. No.: 17/548,226

(22) Filed: Dec. 10, 2021

(65) Prior Publication Data

US 2022/0185553 A1 Jun. 16, 2022

Related U.S. Application Data

(60) Provisional application No. 63/123,679, filed on Dec. 10, 2020.

(51) Int. Cl.
*B65D 51/32* (2006.01)
*A45D 34/04* (2006.01)
*B65D 50/04* (2006.01)

(52) U.S. Cl.
CPC ..... *B65D 51/32* (2013.01); *A45D 34/04* (2013.01); *B65D 50/046* (2013.01)

(58) Field of Classification Search
CPC ..... B65D 50/046; B65D 51/32; B65D 50/04; B65D 50/02; A45D 34/048; A45D 34/04; A45D 34/043; A45C 34/045
USPC ..... 220/376, 212
See application file for complete search history.

(56) References Cited

U.S. PATENT DOCUMENTS

| | | | | |
|---|---|---|---|---|
| 2,043,678 | A * | 6/1936 | Schmalz | B65D 51/32 604/1 |
| 3,992,116 | A | 11/1976 | Fomby | |
| 5,230,433 | A | 7/1993 | Hamilton et al. | |
| 6,202,869 | B1 | 3/2001 | Sullivan | |
| 8,777,032 | B2 | 7/2014 | Biesecker et al. | |
| 8,807,359 | B2 | 8/2014 | Giraud et al. | |
| 8,915,393 | B2 | 12/2014 | Hayton et al. | |
| 9,150,339 | B2 | 10/2015 | Giraud et al. | |
| 9,187,220 | B2 | 11/2015 | Biesecker et al. | |
| 9,387,149 | B2 | 7/2016 | Jones et al. | |
| 9,456,663 | B1 | 10/2016 | Wheeler et al. | |
| 9,481,496 | B2 | 11/2016 | Cottle et al. | |
| 9,481,497 | B1 | 11/2016 | White | |
| 9,527,637 | B2 | 12/2016 | Habibi-Naini | |

(Continued)

FOREIGN PATENT DOCUMENTS

| | | | |
|---|---|---|---|
| CA | 2637679 | A1 | 7/2007 |
| CA | 3043607 | A1 | 5/2018 |

(Continued)

*Primary Examiner* — Rafael A Ortiz
(74) *Attorney, Agent, or Firm* — Procopio, Cory, Hargreaves & Savitch LLP

(57) ABSTRACT

A resealable, access-resistant assembly, including a cap and a stem, is configured to fasten to a container by way of opposing tabs that, when pinched towards each other, deflect from a locked to unlocked position to then be separated (e.g., lifted off of or unscrewed) from the container. The cap is permanently affixed or removably coupled to a stem that extends down from the cap into the container. When the cap is separated from the container, the stem may be positioned to extend into the container to engage material within it or for other miscellaneous uses.

2 Claims, 9 Drawing Sheets

600

700

(56) References Cited

U.S. PATENT DOCUMENTS

| | | | | |
|---|---|---|---|---|
| 9,567,141 | B2 | 2/2017 | Sonheider et al. | |
| 9,617,047 | B2 | 4/2017 | Goettke et al. | |
| 9,771,190 | B2 | 9/2017 | Piscopo | |
| 9,889,976 | B2 | 2/2018 | Miller et al. | |
| 9,889,977 | B2 | 2/2018 | Piscopo | |
| 9,896,250 | B2 | 2/2018 | Minnette et al. | |
| 9,926,114 | B2 | 3/2018 | Eberlein | |
| 9,932,156 | B2 | 4/2018 | Baker | |
| 9,950,844 | B2 | 4/2018 | Barber et al. | |
| 10,011,406 | B2 | 7/2018 | Daley et al. | |
| 10,124,941 | B2 | 11/2018 | Sibley et al. | |
| 10,159,627 | B2 | 12/2018 | Milante | |
| 10,442,587 | B2 | 10/2019 | Daley et al. | |
| 10,597,205 | B2 | 3/2020 | Sibley et al. | |
| 10,618,707 | B2 | 4/2020 | Straughan | |
| D887,843 | S | 6/2020 | Smith et al. | |
| 10,676,258 | B2 | 6/2020 | Lee et al. | |
| 10,703,545 | B1 | 7/2020 | Miceli et al. | |
| 10,737,853 | B2 | 8/2020 | Giraud et al. | |
| 10,766,674 | B2 | 9/2020 | Agrawal et al. | |
| 10,799,424 | B2 | 10/2020 | Knobel et al. | |
| 10,827,817 | B2 | 11/2020 | Chevalier | |
| 10,829,276 | B2 | 11/2020 | Hohm et al. | |
| 2002/0088825 | A1 | 7/2002 | Laverdure | |
| 2007/0187431 | A1 | 8/2007 | Manker | |
| 2009/0277902 | A1* | 11/2009 | Darflinger | B65D 51/246 220/212 |
| 2011/0192845 | A1* | 8/2011 | Swartz | A47J 43/044 220/212 |
| 2015/0166231 | A1* | 6/2015 | Taylor | B65D 51/185 220/255 |
| 2017/0275067 | A1* | 9/2017 | Massinello | B65D 51/32 |
| 2017/0332767 | A1* | 11/2017 | Schreiber | B65D 51/32 |
| 2018/0194526 | A1* | 7/2018 | Enterline | B65D 51/32 |
| 2018/0361048 | A1 | 12/2018 | Scarpaci et al. | |
| 2019/0145536 | A1* | 5/2019 | Allen | F41J 5/26 137/232 |
| 2019/0276201 | A1* | 9/2019 | French | B65D 50/043 |
| 2019/0343261 | A1* | 11/2019 | Jung | B65D 47/18 |
| 2020/0039707 | A1 | 2/2020 | Kachian et al. | |
| 2020/0062484 | A1* | 2/2020 | Machado | B65D 81/3216 |
| 2020/0102130 | A1* | 4/2020 | Parekh | B65D 1/0215 |
| 2020/0156831 | A1* | 5/2020 | Tapocik | B65D 35/38 |
| 2020/0198856 | A1* | 6/2020 | Sterling | B65D 55/024 |
| 2020/0324947 | A1* | 10/2020 | Cunningham | B01F 33/86 |
| 2020/0352395 | A1* | 11/2020 | Bushby | B01F 33/5011 |
| 2021/0298501 | A1* | 9/2021 | Condurso | B65D 51/32 |
| 2022/0175110 | A1* | 6/2022 | Chinnakaruppan | A45D 34/043 |

FOREIGN PATENT DOCUMENTS

| | | | |
|---|---|---|---|
| EP | 0624139 | A1 | 8/1993 |
| WO | 2007/016249 | A2 | 2/2007 |
| WO | 2008/048606 | A2 | 4/2008 |
| WO | 2008/154575 | A1 | 12/2008 |
| WO | 2014204890 | A1 | 12/2014 |

* cited by examiner

600

CONTAINER ASSEMBLY WITH CAP WITH STEM

CROSS-REFERENCE TO RELATED APPLICATIONS

This application claims benefit of priority from Provisional U.S. Patent application Ser. No. 63/123,679, filed Dec. 10, 2020, the contents of which are incorporated by reference.

BACKGROUND

Technical Field

The present disclosure relates a container assembly including a cap with a detachable stem.

Related Art

Related art containers may include a cap and an applicator. For example, for liquid cosmetic applications such as mascara or a lip gloss flexible brush tip, the applicator is generally not detachable from cap. A dispenser for a liquid may be provided with a discharge head in the case of tincture or a liquid dropper. Similarly, the applicator is generally not detachable from the cap.

Additional related art approaches may include brush applicators, such as a rubber cement brush tip. However, the related art brush applicators are not detachable from cap. Other related art is designed for liquid discharge or brush applications, such that the functional component is not detachable from the cap.

Related art leverage mechanisms that may be provided to release a cap from a container, such as a) screw caps using axial force in conjunction with rotation to release, b) push-buttons that disengage a clasp, often connected to container via a hinge, c) containers that may be squeezed to release the cap, often connected to container via a hinge, or d) some variation or combination of the above related approaches. The related approaches may cause wrist strain. For example, related art child-resistant packaging options can further exacerbate wrist strain for users with impaired manual dexterity, especially packaging that requires rotation to open.

SUMMARY

Aspects of the example implementations include an assembly, consisting of a cap in conjunction with a permanently affixed or removably coupled stem, whereby the stem is designed to extend into a container for sanitary storage of the stem or to engage material within the container.

Additional aspects may provide for functional utility of the stem, whether affixed to or removably coupled from the cap, and may be enhanced through accessories designed to attach to the stem.

Still further, aspects may include a cap configured to fasten to a container, whereby the cap is divided into opposing stationary side walls and opposing push-tabs that deflect in response to applied pressure from a first state (e.g., locked position) to a second state (e.g., unlocked position), wherein the protrusions on a lower interior portion of each of the opposing push-tabs latch against the top surface of the retaining groove of the container; and a lower portion of each of the opposing push-tabs deflects beyond the top surface of the retaining groove of the container and into the second state when a top portion of each of the opposing push-tabs is urged towards each other with applied pressure; such that when the opposing push-tabs are in the second state the assembly can be removed from the container to permit access to an interior of the container.

Still further, aspects may include a seal formed between an inner diameter of the container and a sealing taper of the cap when fastened to the container in the first state.

Additional aspects may include the cap being coupled with the stem.

DETAILED DESCRIPTION

Figure 1:
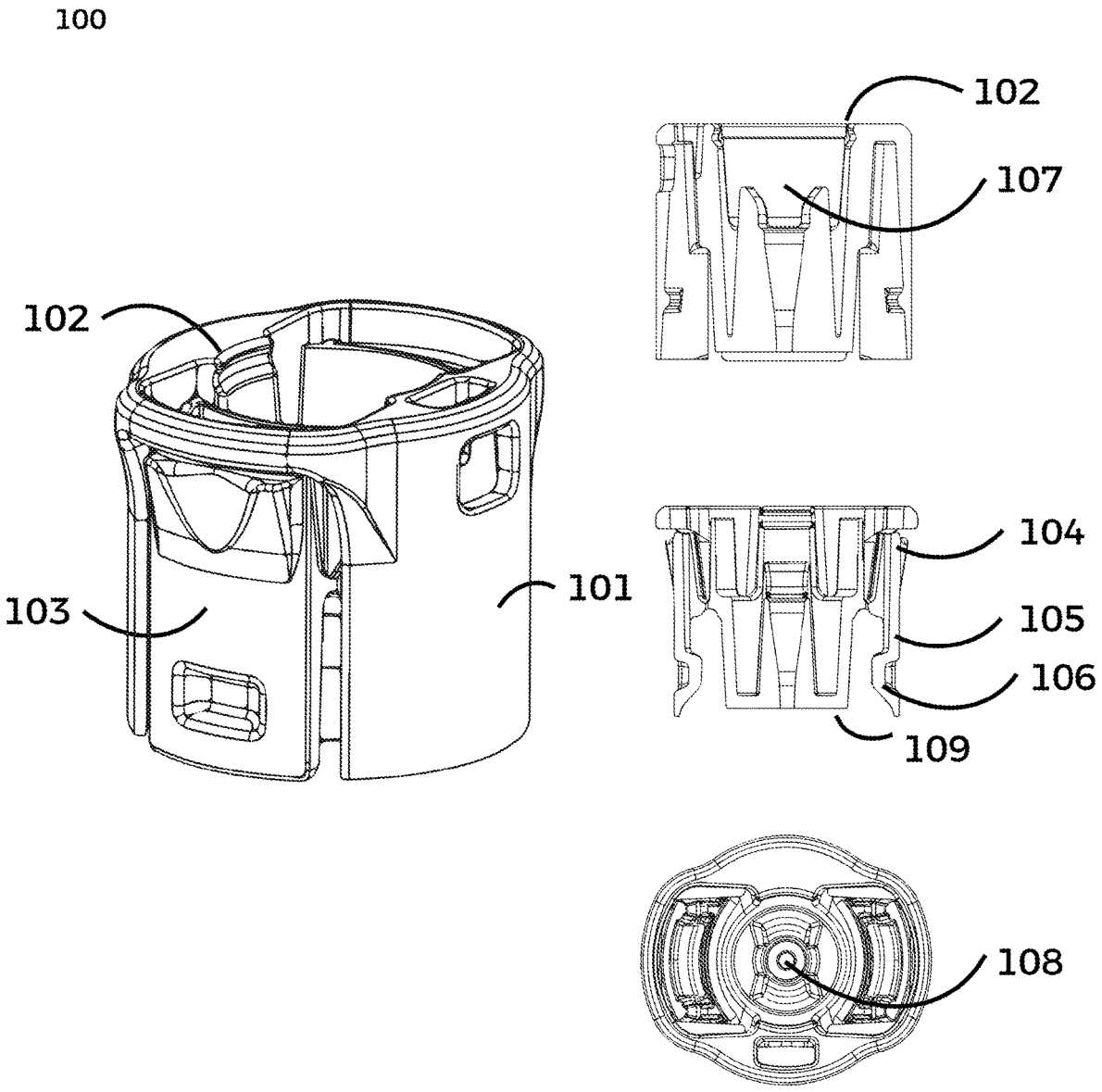
FIG. 1 illustrates a cap in accordance with an example implementation of the present application.

The following detailed description provides further details of the figures and example implementations of the present application. Reference numerals and descriptions of redundant elements between figures are omitted for clarity. Terms used throughout the description are provided as examples and are not intended to be limiting.

Aspects of the example implementations are directed to a container, cap and stem. The container is resealable, and is access resistant, such as child-resistant. The stem extends to a portion of the container opposite the cap, and the stem is detachably attached to the cap.

A resealable, access-resistant and/or child-resistant packaging assembly 300 according to the example implementations is configured to fasten to a container 400 and includes a cap 100 with a stem 200 used to engage 700 material within the container 400. While the term "child-resistant" is used, and may refer to one example implementation that is certified as being resistant to undesirable opening of the assembly by a child (e.g., medicine or controlled substance), the example implementations are not limited thereto. For example, but not by way of limitation, the example implementation may be more generally access-resistant, to avoid unintentional or undesired opening of the assembly.

Figure 2:
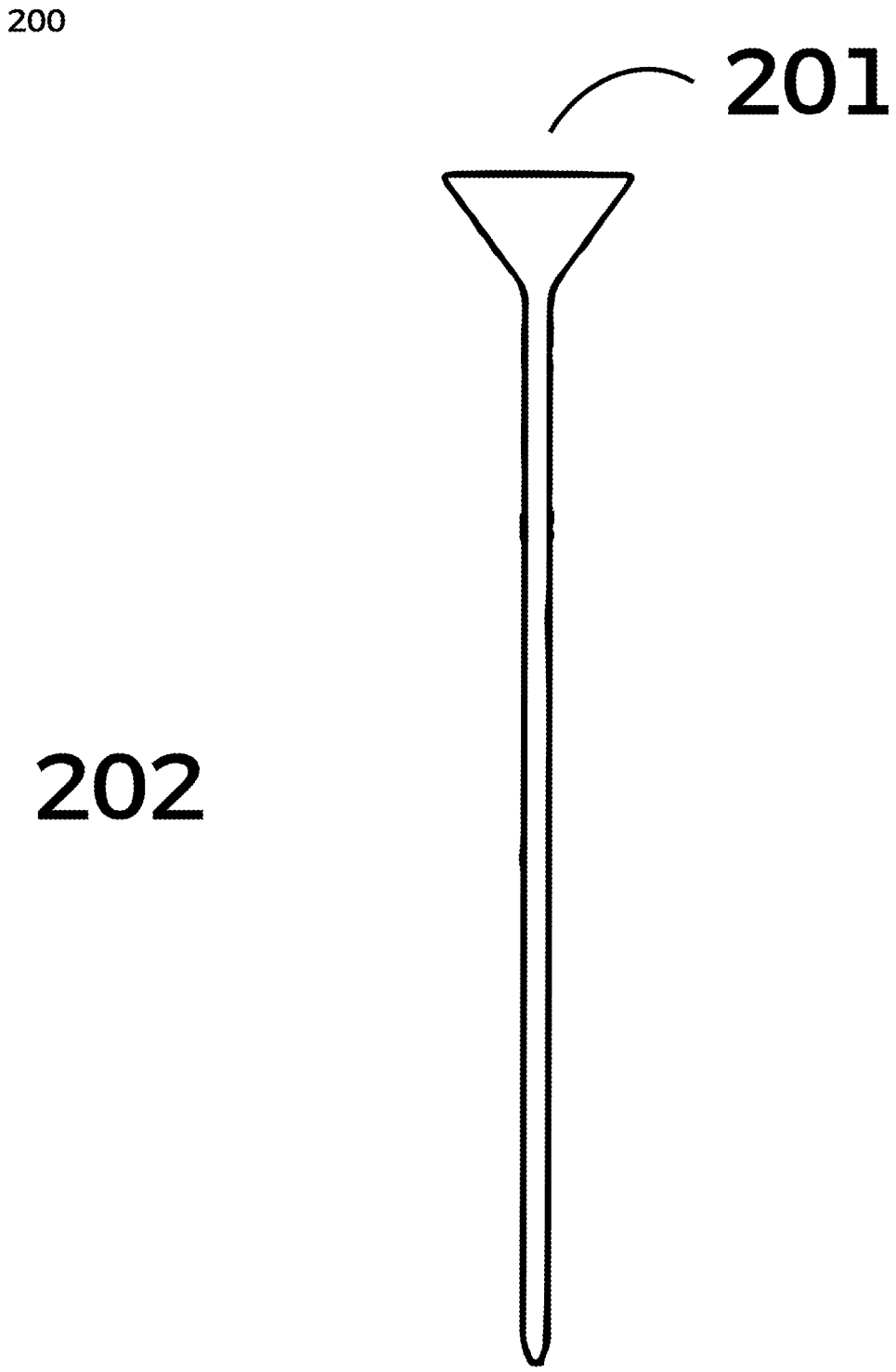
FIG. 2 illustrates a stem in accordance with an example implementation of the present application.
Figure 3:
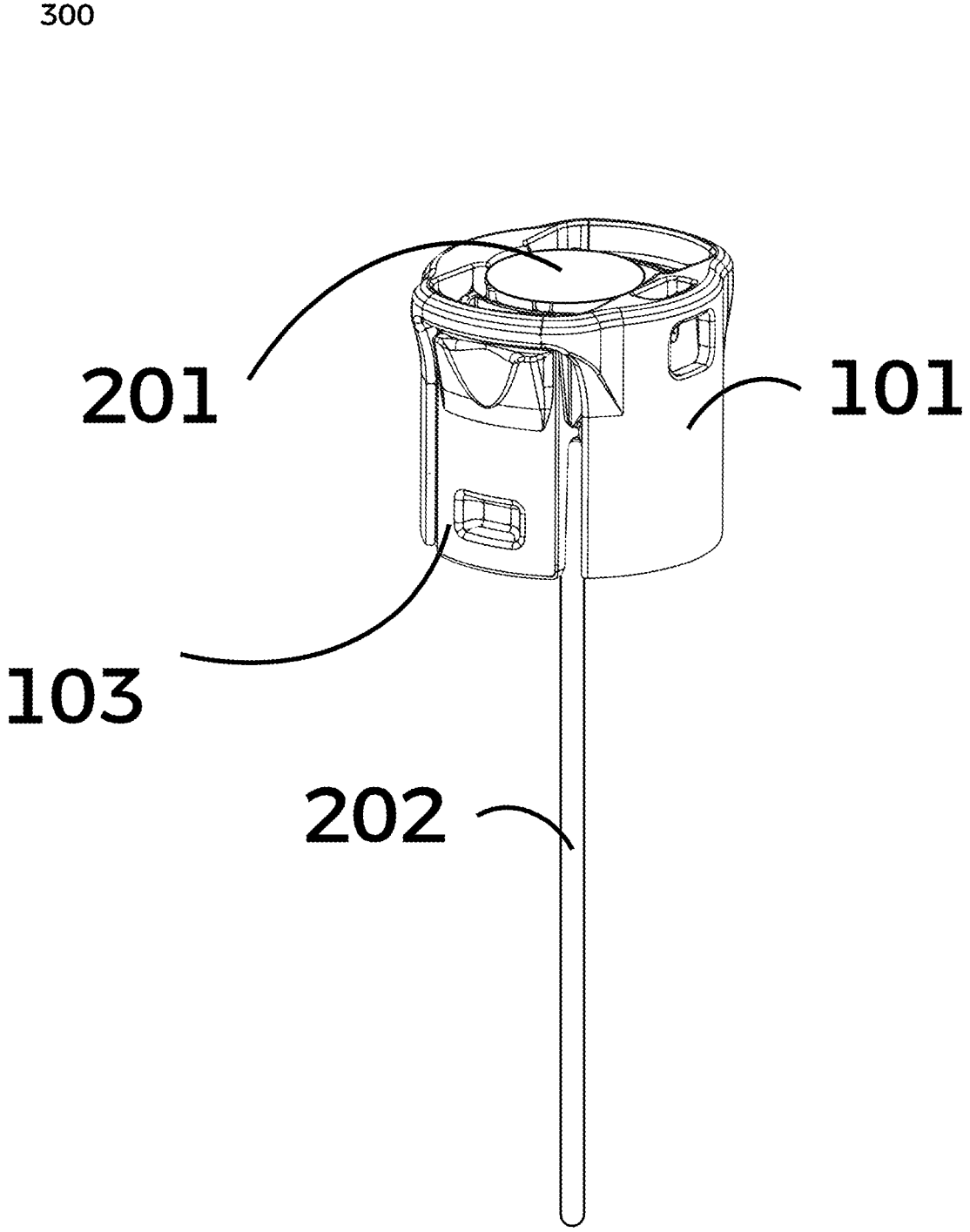
FIG. 3 illustrates the assembly, consisting of a cap and stem, in accordance with an example implementation of the present application.
Figure 4:
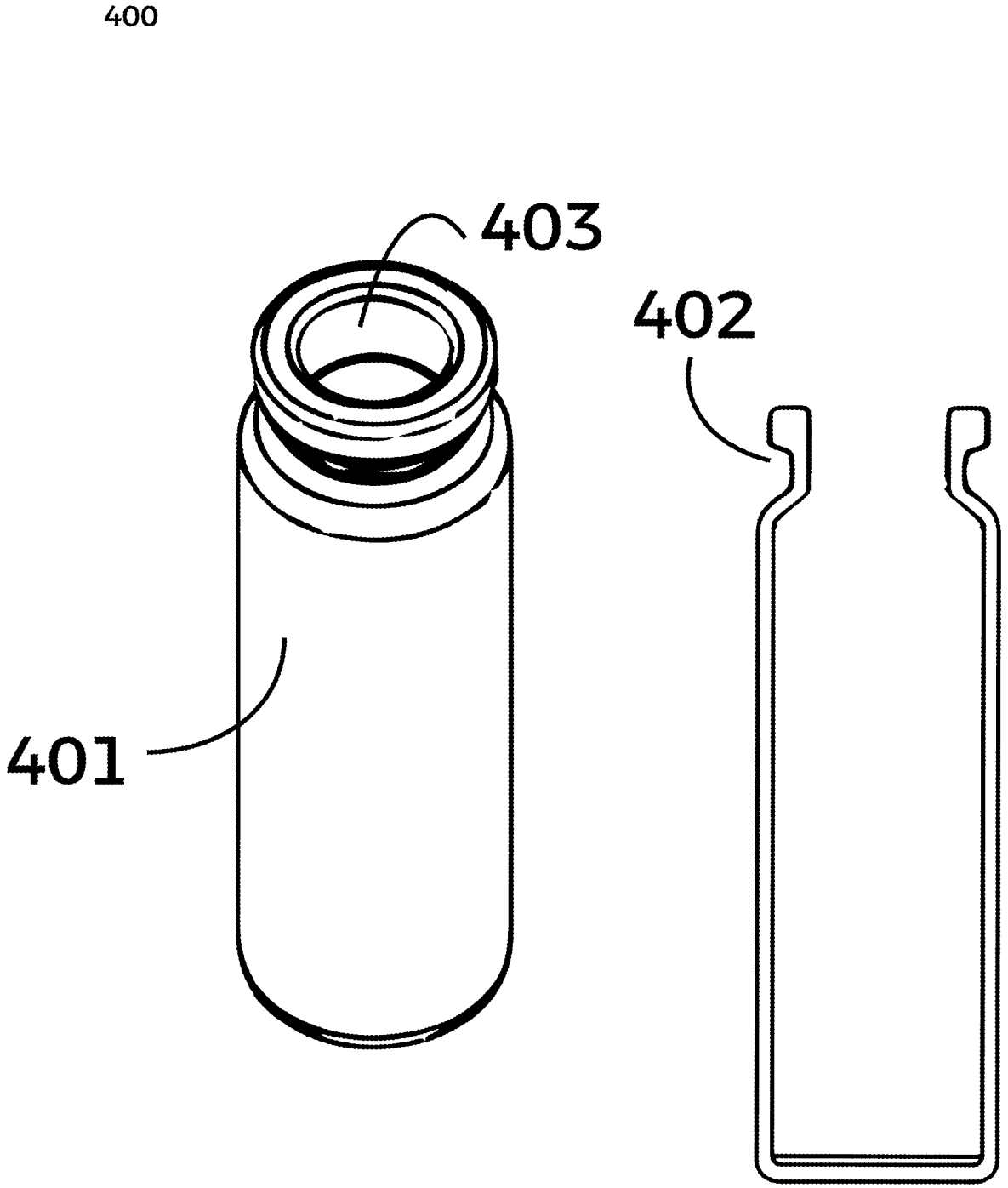
FIG. 4 illustrates a container in accordance with an example implementation of the present application.

A resealable, access-resistant (e.g., child-resistant) packaging assembly 300 illustrated in FIG. 3, including a cap 100 and a stem 200, illustrated in FIG. 1 and FIG. 2 respectively, configured to fasten to a container 400. Either permanently affixed or removably coupled to the cap 100 is a stem 200 including a head 201 that secures the stem to the cap and a narrow shaft 202 that extends into the container 400.

Figure 7:
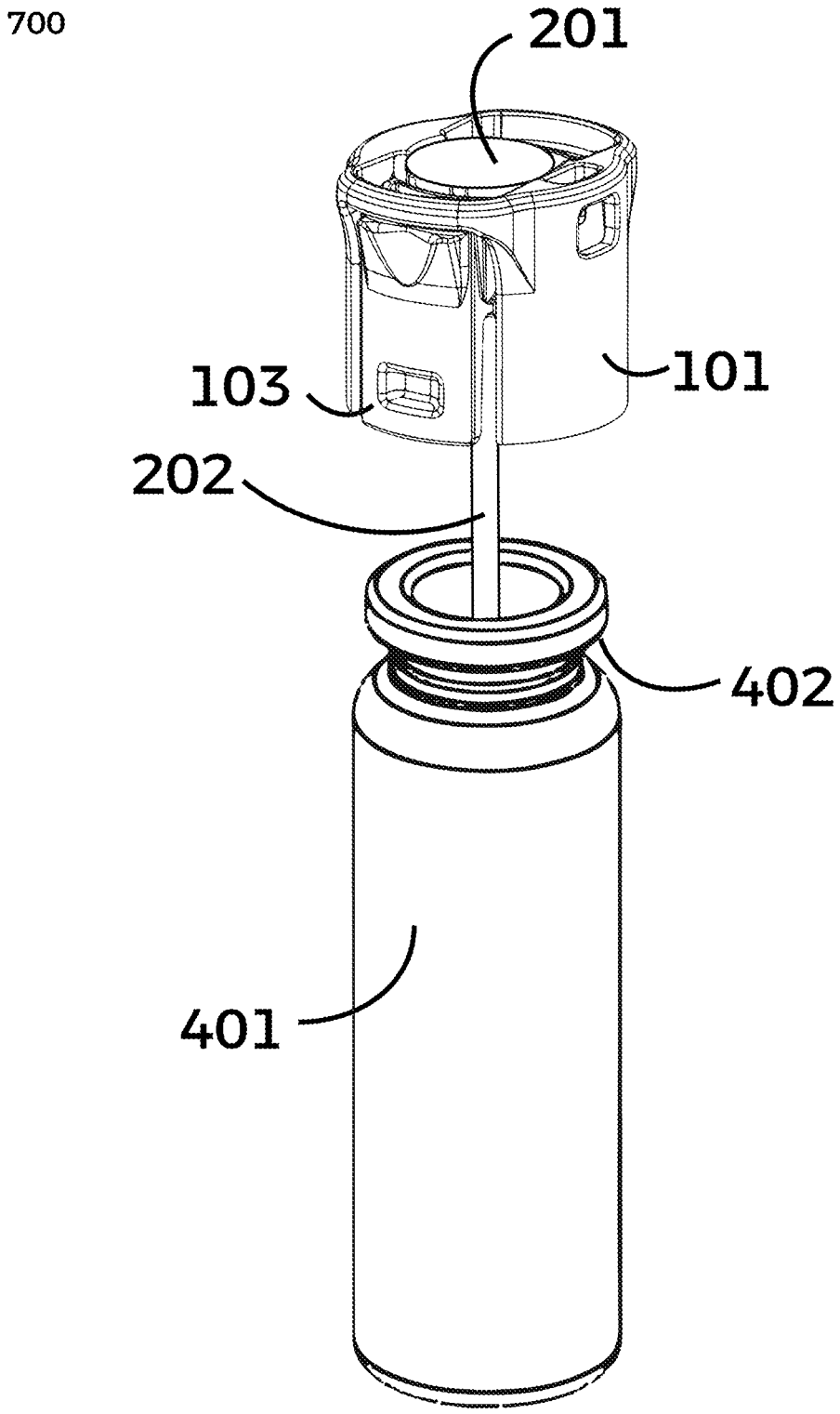
FIG. 7 illustrates usage of the assembly with the container in accordance with an example implementation of the present application, particularly the use of the stem portion of the assembly to engage material within the container when the assembly is separated from the container.
Figure 8:
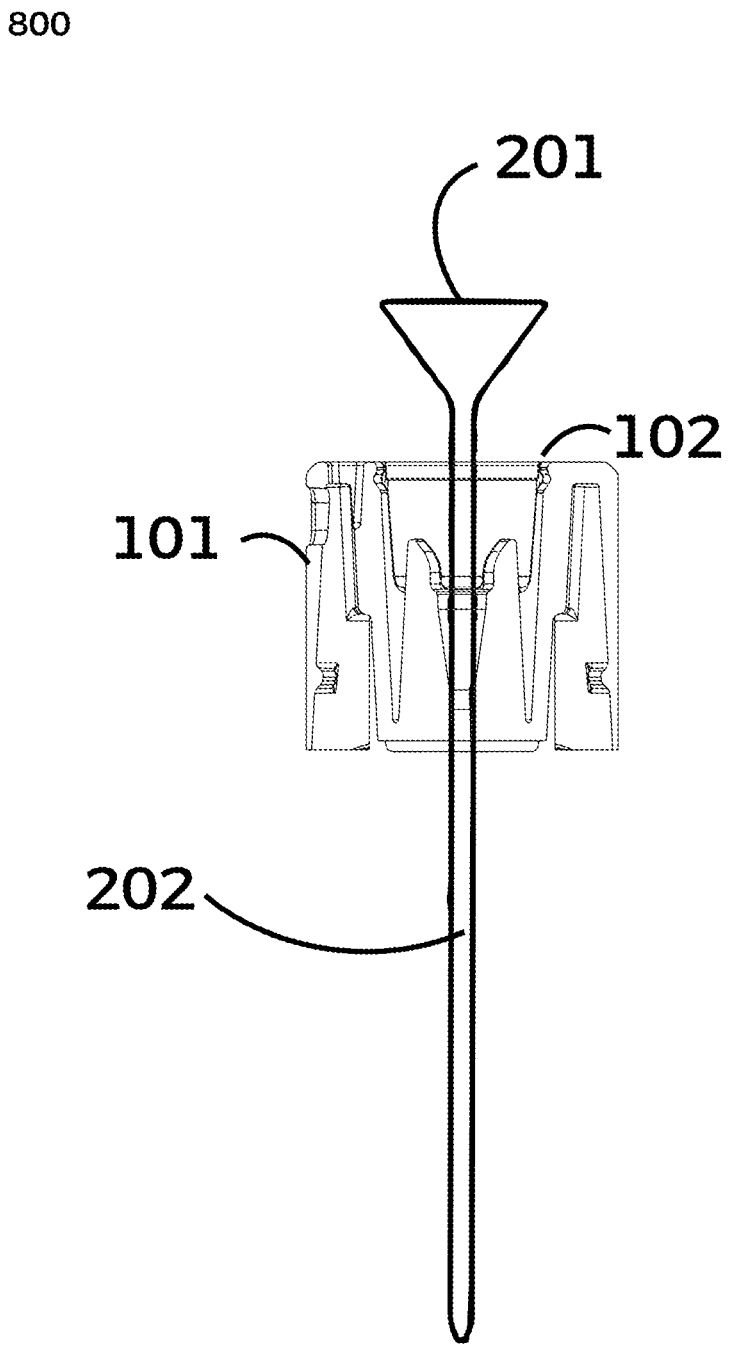
FIG. 8 illustrates usage of the cap and stem components of the assembly in accordance with an example implementation of the present application, particularly the separation of the stem from the cap, applicable when the configuration of the stem is removably coupled to the cap; not applicable when stem is permanently affixed to the cap.

As shown in FIG. 7 and FIG. 8 respectively, the stem 200 may be used, either attached 700 or detached 800 from the cap, to engage 700 material within the container 400 or for other miscellaneous uses. As shown in FIG. 1, the circumference of the cylindrical cap 100 is divided into two cross sections; two opposing stationary side walls 101 and two opposing push-tabs 103 with locked 500 and unlocked 600 positions, illustrated in FIG. 5 and FIG., respectively.

Figure 5:
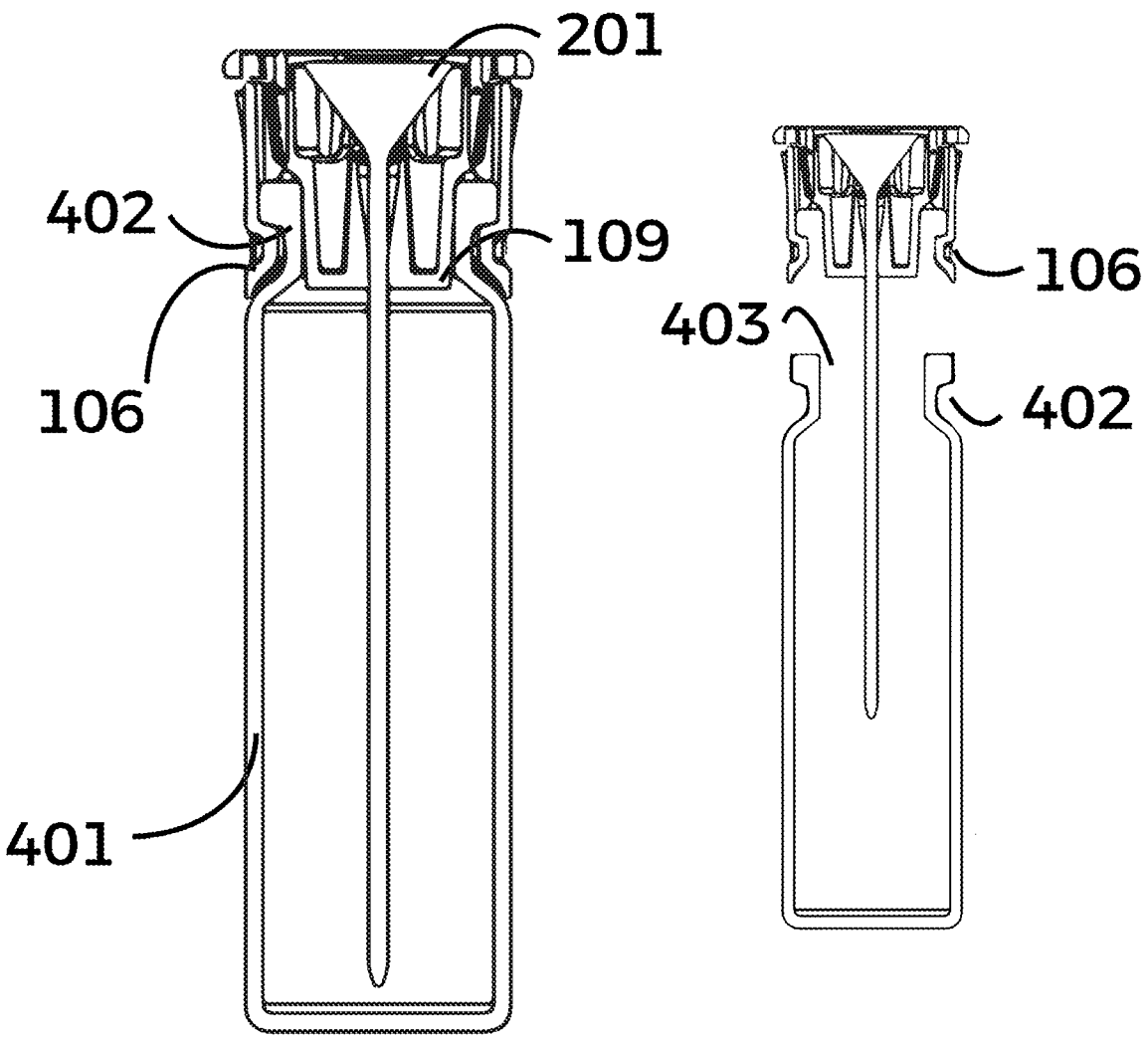
FIG. 5 illustrates a container with the assembly, consisting of cap and stem, in accordance with an example implementation of the present application, particularly the locked position of the assembly.
Figure 6:
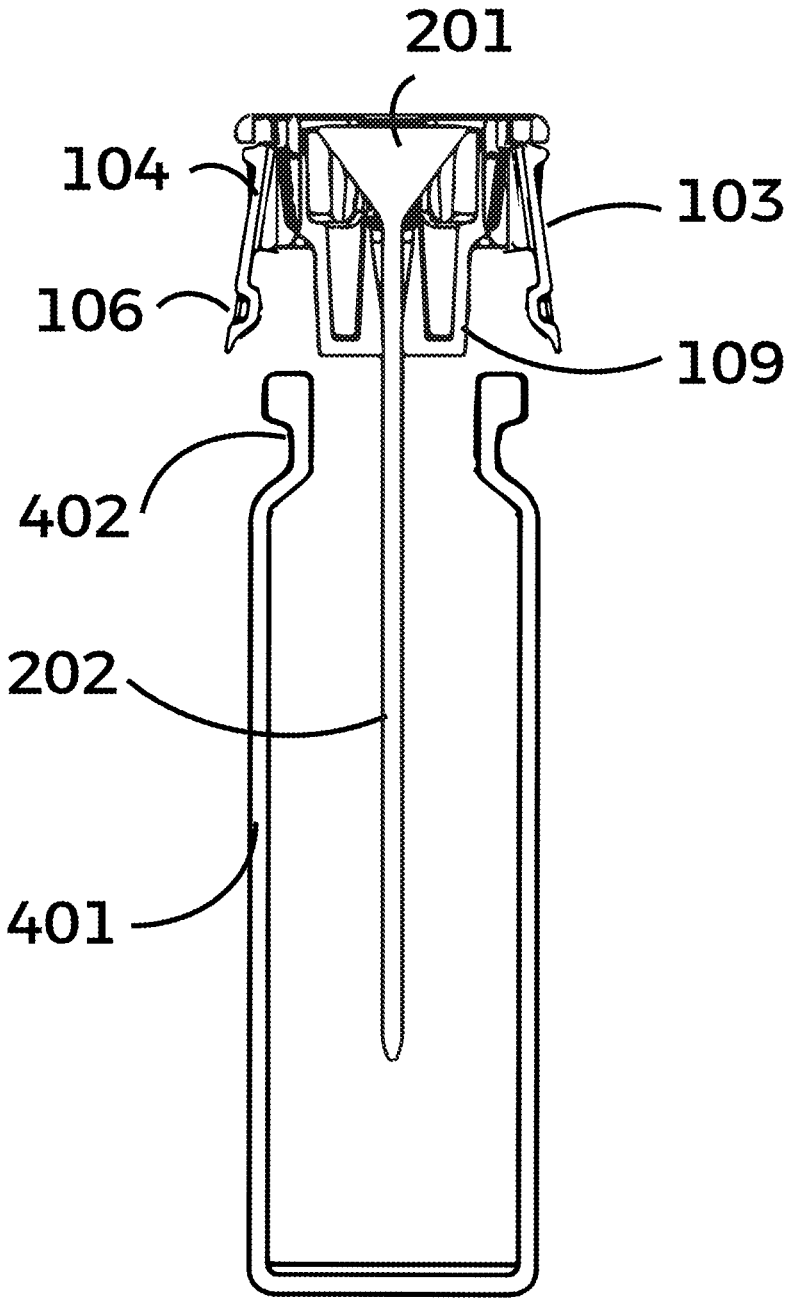
FIG. 6 illustrates usage of the cap with the container in accordance with an example implementation of the present application, particularly the unlocked position of the cap.

As shown in FIG. 5, when in the locked position 500, a protrusion 106 on the lower interior portion of each push-tab 103 latches against the top surface of the retaining groove 402 of the container, additionally forming a seal between the inner diameter 403 of the container and the sealing taper 109 of the cap. By pinching the top portion 104 of the tabs towards each other, the lower portion 105 of each tab deflects outward beyond the top surface of the retaining groove 402 of the container 400 and into an unlocked position 600. As shown in FIG. 6, only when the tabs are held in the unlocked position 600 may the cap 100 be removed (e.g., lifted off of or unscrewed) from the container 400 to gain access to its contents.

Components of the example implementations are disclosed as follows, in conjunction with the drawings. An access-resistant cap 300 includes two components. A stem 200 includes a shaped head 201 and narrow shaft 202, not to exceed the length of the container 400. The stem 200 is configured to be permanently affixed or removably coupled to a cap and to extend into the container when secured in a locked position. Example implementations can be applied to a variety of different cap designs (including but not limited to the cap design 100 provided herein), so long as the cap is designed with specific dimensions that are complimentary to the stem 200 to achieve a permanently affixed or removably coupled assembly.

A cap 100, such as a cylindrical cap, is divided into two cross sections. Two opposing stationary side walls 101 and two opposing push-tabs 103 are provided with locking protrusions 106, which deflect from a locked 500 to unlocked position 600. Example implementations of the dual-pinch-and-pull cap are separate and distinct from the stem, and may be utilized to achieve an access-resistant packaging enclosure, with or without a stem.

The foregoing cap 100 and stem 200 may be collectively referred to as the assembly 300.

A container 400 is also provided. Example implementations can be applied to a variety of different container 400 options. For example, material types may include but are not limited to glass, plastic, rubber, metal, wood, stone, ceramic, acrylic. The container may include varying shapes and sizes for the base 401 of the container 400. The inner diameter 403 and retaining groove 402 of the container 400 are designed with specific dimensions that are complementary to the assembly 300 to achieve the locked 500 and unlocked positions 600.

The assembly 300 and container 400, when in the locked position 500, may be collectively referred to as the capsule.

A manner of connection of the above-described components is disclosed as follows. The cap 100 and the stem 200, may collectively be referred to as the assembly 300. The stem 200 extends down from the center cavity 107 of the cap 100, held into place at the head of the stem by the top interior edges 102 of the opposing side walls 101 of the cap 100. When removably coupled, the stem 200 can be removed from the cap 100 by applying upward pressure to the bottom of the shaft 202 to release the head 201 of the stem 200 from the center cavity 107 of the cap 100, by way of a hole 108 in the center of the cap.

Assembly 300 and container 400, may collectively be referred to as the capsule 500. By pinching the top portion 104 of the push-tabs 103 towards each other, the lower portions 105 of each push-tab 103 deflect outward beyond the top surface of the retaining groove 402 of the container 400 and into the unlocked position 600. When the tabs are held in the unlocked position 600, the assembly may be lifted off of the container 400 to gain access to its contents.

To reconnect the assembly 300 to the container 400, the push-tabs 103 may be pinched into the unlocked position 600 and held in this position, while placing the assembly 300 over the container 400. Once the sealing taper 109 of cap 100 is inserted into the container 400, the push-tabs may be released to return to the locked position 500.

The example implementation may have various advantages and benefits. For example, the combination of a cap with a stem 200 that creates a functional assembly for the purpose of engaging 700 material within the container 400. The stem may be permanently affixed or removably coupled to the cap, by one of various attachment mechanisms. For example, the mechanisms may include, but are not limited to, a top-mounted stem that pierces through the cap as illustrated in FIG. 3, a stem that screws in, clips in, magnetically affixes, or other various means of attaching to the cap in a removably coupled fashion, or a stem that is permanently affixed to the cap.

Figure 9:
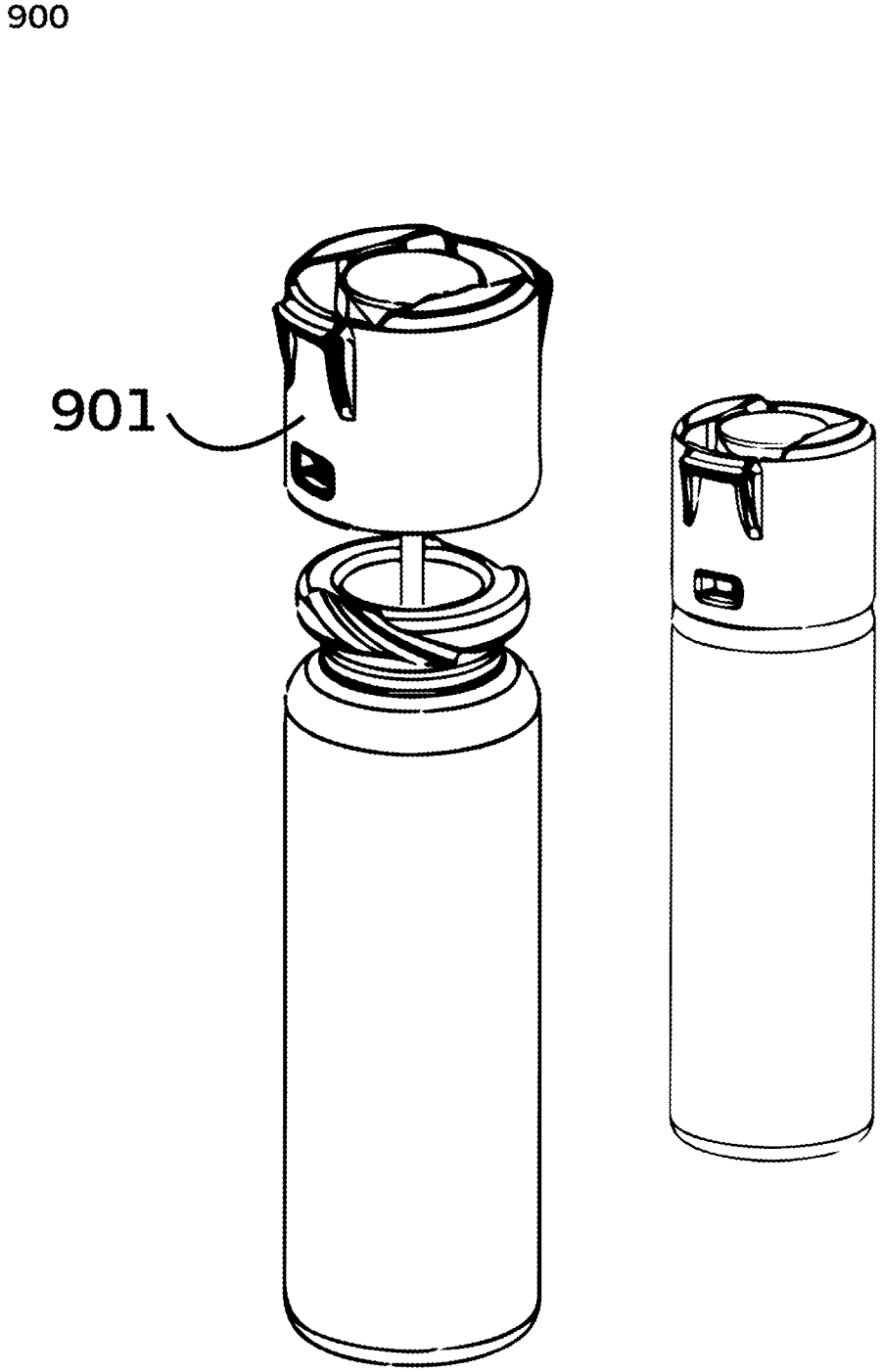
FIG. 9 illustrates usage of the assembly in accordance with an example implementation with an alternate threaded screw cap design, varying from the other FIGS. that illustrate the dual-pinch-and-pull cap in accordance with an example implementation.

The cap may fasten to a container by one of various enclosure mechanisms, including but not limited to the dual-pinch-and-pull cap design illustrated in FIG. 1, or an alternate cap design 901 that leverages another form of fastening to the container, including but not limited to threaded screw caps, such as the example implementation illustrated in FIG. 9, squeeze-pop caps, push-and-rotate caps, etc.

Furthermore, the related art is distinguishable from the example implementations, for example, with respect to liquid cosmetic applications, which are generally not detachable from cap (e.g., mascara or lip gloss flexible brush tip), dispensers for liquid with discharge head, which are generally not detachable from cap (e.g., tincture or liquid dropper), brush applicators, which generally are not detachable from cap (e.g., rubber cement brush tip), and other related art generally designed for liquid discharge or brush applications, whereby the functional component is generally not detachable from the cap.

Additionally, the dual-pinch-and-pull cap mechanism 100 is provided to release the access-resistant (e.g., child-resistant) lock 500, whereby pinching opposing push-tabs 103 (e.g., two) on the cap 100 towards each other cause the tabs to elastically deflect 600 to release locking protrusions and, while held in the unlocked position, the cap may be pulled upwards to separate the cap 100 from the container 400. Meanwhile, prior related art leverage alternative mechanisms to release a cap from a container, such as a) screw caps using axial force in conjunction with rotation to release, b) a push-button to disengage clasp, often connected to container via a hinge, c) a squeeze container that may be squeezed to release a cap, often connected to container via a hinge, or d) some variation or combination of the above.

The example implementation of the cap assembly with stem provides users with a functional tool that can be stored in the sanitary environment of the container or used to engage material within the container, for example to remove material from the container or to adhere viscous material to the stem to avoid contact with the sides of the container. This may be advantageous for products with a tendency to stick to the interior of the package container.

The example implementation of the dual-pinch-and-pull cap mechanism minimizes wrist strain, whereas related art child-resistant packaging options can further exacerbate wrist strain for users with impaired manual dexterity, especially packaging that requires rotation to open.

The foregoing example implementations may be used for a variety of different product types, including but not limited to consumer packaged goods, both consumables to non-consumables.

Some examples of target consumable industries include, but are not limited to:

Culinary herbs, spices, or other ingredients
Dried botanicals and botanical extracts
Medicinal herbs and teas
Smokables
Seeds
Vitamins
Nutraceuticals
Supplements
Controlled substances Some examples of target non-consumable industries include, but are not limited to:

Forensics and/or chemical testing
Gunpowder
Desiccants
Arts and crafts
Jewelry making
Precious gems and stones
Cosmetics
Hardware and metalware The size of the example implementation may vary. When designed in larger dimensions, the example implementation can be used for long-term material storage. When designed in travel-size dimensions, the example implementation may easily fit into a pocket or purse for portable storage and routine use.

The container and/or stem may be marked with measurement lines to indicate the amount of material remaining in the container. Each measurement line would correspond to a volume of material relative to the interior volume capacity of the container, and could therefore be used for measurement or dosage.

The example implementation may be used as an exterior package for material goods for mass production and sale, such as by a wholesaler. A machine may be provided to fill the container with desired material and successively affix the cap and stem to the filled container.

The example implementation may be purchased and resold as-is (e.g., empty), in its unfilled state, to end-users rather than for use as an exterior package for wholesale or retail goods.

For example, individual end-users may use the example implementation for resealable storage of any desired material, including but not limited to the example product types described in the consumable and non-consumable use cases outlined above.

The example implementation may be sold with accessories that attach to the stem to provide additional functionality for the user. For example, the stem may act as the handle to the accessory. Example accessories include but are not limited to: spoon, trowel, skewer, spatula, knife, wisk, cork screw spiral, chemical meter, thermometer, cleaning swab, or a variety of other accessory attachments.

Other implementations of the present application may be apparent to those skilled in the art from consideration of the specification and practice of the teachings of the present application. Various aspects and/or components of the described example implementations may be used alone or in any combination. It is intended that the specification and example implementations be considered as examples only, with the true scope and spirit of the present application being indicated by the following claims.

The invention claimed is:

1. An assembly, comprising a cap in conjunction with a stem, and the cap is coupled to a container, wherein the stem is single-pieced and comprises a shaped end and a shaft, wherein the stem detaches from the cap by first separating the cap from the container and then vertically ejecting the shaped end of the stem through a top side of the cap by application of pressure on the shaft of the stem to push the stem towards a bottom side of the cap, wherein the stem recouples and secures to the cap by inserting the shaft of the stem through the top side of the cap and pushing the shaped end into the cap until the shaped end is completely embedded within the cap;

wherein the stem extends into the container for sanitary storage of the stem with the cap affixed to the container or to engage material within the container with the cap removed from the container, and wherein recoupling and securing of the stem to the cap comprises inserting the shaft of the stem through a cavity within the top side of the cap until the shaped end is completely embedded within the cap.

2. The assembly of claim 1, wherein application of pressure on the shaft of the stem comprises application of pressure on the shaft of the stem towards the bottom side of the cap to release the shaped end from the cavity after the cap is separated from the container.

* * * * *